US005295792A

United States Patent [19]

Shackford

[11] Patent Number: 5,295,792

[45] Date of Patent: Mar. 22, 1994

[54] METHOD FOR NON-DESTRUCTIVELY COMPRESSING OZONE GAS

[75] Inventor: Lewis D. Shackford, Merrimack, N.H.

[73] Assignee: Ingersoll-Rand Company, Woodcliff Lake, N.J.

[21] Appl. No.: 43,055

[22] Filed: Apr. 5, 1993

[51] Int. Cl.[5] ..... F04C 19/00

[52] U.S. Cl. ..... 417/55; 417/68

[58] Field of Search ..... 417/55, 68

[56] References Cited

U.S. PATENT DOCUMENTS

| | | | |
|---|---|---|---|
| 1,991,548 | 2/1935 | De Motte | 417/68 |
| 3,289,918 | 12/1966 | Adams | 417/68 |
| 3,315,879 | 4/1967 | Jennings | 417/69 |
| 3,481,529 | 12/1969 | Mugele | 417/69 |
| 3,929,399 | 12/1975 | Aronson | 417/54 |
| 3,954,567 | 5/1976 | Fischer et al. | 417/68 |
| 4,257,749 | 3/1981 | Ramm | 417/68 |
| 4,315,717 | 2/1982 | King | 417/69 |
| 4,359,313 | 11/1982 | Bernard | 417/68 |
| 4,484,457 | 11/1984 | Mugele | 62/500 |
| 4,718,834 | 1/1988 | Ebner et al. | 417/54 |
| 4,946,349 | 8/1990 | Manabe et al. | 417/68 |
| 5,043,079 | 8/1991 | Hallett | 210/748 |

*Primary Examiner*—Richard E. Gluck

*Attorney, Agent, or Firm*—Robert F. Palermo

[57] ABSTRACT

A method for non-destructive compression of a reactive gas such as ozone employs a liquid used as a compressant or sealant in a compressor where the liquid is substantially free of elements which decompose the gas. Provision is also made for extraction of heat of compression absorbed by the liquid of the compressant or sealant, for addition of chilled and pH adjusted liquid, and for addition of acid, if necessary.

12 Claims, 3 Drawing Sheets

METHOD FOR NON-DESTRUCTIVELY COMPRESSING OZONE GAS

BACKGROUND OF THE INVENTION

This invention relates generally to gas handling in industrial processes and more particularly to compression of gases which are subject to thermal or catalyzed decomposition, such as ozone.

Compression of gases generates heat of compression which goes to increase the temperature of the gas. Often this heat is removed from the compressed gas by passing it through an aftercooler which exchanges the heat with a reservoir of cool or refrigerated medium. Some gases are unstable and decompose due to the temperature increase attendant upon compression.

Ozone gas is used in many industrial processes. It is produced in ozone generators from air or oxygen in concentrations of up to about 15% by weight of ozone in air or oxygen carrier gas. Ozone generators normally produce ozone at less than about 15 psig in order to minimize capital costs for the generation equipment and to maintain high ozone generation efficiency.

Low pressure ozone is suitable for many processes, but many modern technologies require ozone at higher pressures. Also, many technologies require ozone at high concentrations in a variety of compatible carrier gases such as air, nitrogen, or oxygen.

Compression of ozone by commonly available reciprocating compressors or centrifugal compressors results in adiabatic heating and consequent thermal decomposition of a fraction of the ozone. By cooling the working parts of such compressors, or by providing intercoolers between stages, and aftercoolers for the compressed gas, most of the thermal decomposition can be avoided. However, such measures greatly increase the cost of such compressors; and half-measures still result in too great a loss of ozone to be acceptable.

One example of a technology which requires compressed ozone is bleaching of wood pulp at consistencies lower than about 45%. A typical system for bleaching low to medium consistency, i.e., up to about 18% consistency, may require an ozone pressure of between 30 and 200 psig for effectively contacting the ozone with the pulp or for effectively dissolving the ozone in a pulp bearing fluid. It is to be expected that an increasing number of processes will be and have been developed in a wide variety of technical fields which will require compressed ozone containing gases.

A liquid ring compressor may be used for compression of thermally reactive gas. Such compressors employ a liquid to act as an internal sealant between the casing of the compressor and the rotating vanes. The liquid forms a ring, by centrifugal action, against the compression chamber wall; and, by alternately filling and emptying the spaces between the vanes of the radially offset impeller, the liquid ring also serves as the compressant for the gas being compressed. Heat of compression is quite readily transferred from the gas to the liquid permitting the liquid ring compressor to approximate isothermal operation. This suppresses the thermal decomposition of the compressed gas and causes a corresponding increase in vapor pressure of the liquid ring. A quantity of the liquid may be discharged with the compressed gas and must be replenished for continuing operation.

In the case of ozone and some other gases, suppression of thermal decomposition is not alone sufficient to preserve the compressed ozone. Since ozone is very reactive, it is also subject to consumption and decomposition by reaction with the liquid of the liquid ring. Ozone even reacts with water in a variety of reactions which are well documented. One article dealing with these reactions is Weiss, J., "Reaction of Ozone With Water", Transactions of the Faraday Society, 31, 668 (1935), which is incorporated herein by reference.

Since ozone is a costly gaseous reagent, any measurable loss is to be avoided. Thus, with an ever increasing technological demand for high pressure ozone, the need for a non-destructive compression process becomes more urgent.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a method for non-destructively compressing ozone gas including using a compressor having a liquid serving as an internal sealant and/or compressant, the liquid being a cooled liquid which is substantially free of reactants which promote decomposition of the ozone; feeding the ozone gas to an inlet of the compressor; and extraction of the compressed ozone gas from a discharge of the compressor for use in a subsequent process.

The foregoing and other aspects will become apparent from the following detailed description of the invention when considered in conjunction with the accompanying drawing figures.

DETAILED DESCRIPTION OF THE INVENTION

Figure 1:
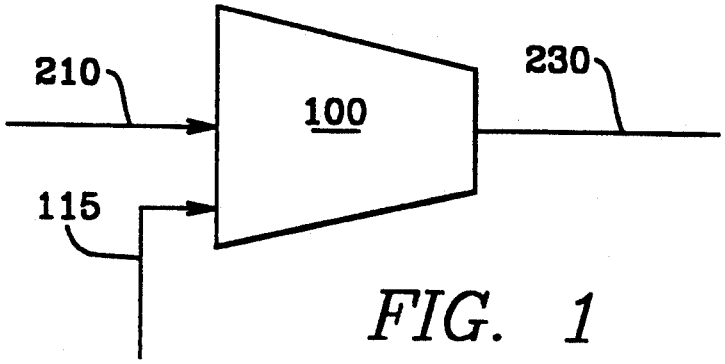
FIG. 1 is a symbolic representation of the compressor of the present invention which includes a liquid sealant and/or compressant.

FIG. 1 shows a schematic view of a compressor, 100, which uses a liquid as a sealant or compressant. Depending on the design of such a unit, this may have a cylindrical housing with rotor offset from center, or an elliptical housing with the rotor on center. In this liquid ring type compressor 100, the liquid is fed to the compressor through inlet pipe 115, and takes on the shape of the housing which forms a converging annulus which compresses the gas from gas inlet 210, to gas outlet 230, during each rotation of the rotor. In the case of a compressor 100 using a liquid, as a sealant only, fed to the compressor through inlet pipe 115; the gas is positively displaced through intermeshing petals and grooves, as the liquid sealant is used to prevent leakage between each compression petal/groove pair. Such compressors are commercially available from a number of sources.

For compressing ozone according to the method of the present invention, the liquid sealant and/or compressant must be non-reactive with ozone. Where local water contains elements which may decompose ozone, the best selection for the sealant or compressant liquid may be deionized or demineralized water free of metal ions and other compounds which react with ozone. Ozone will react with even pure water through a variety of mechanisms. Typical reactions are:

$$O_3+OH^- \rightarrow O_2^- + HO^0$$

$$O_3+HO_2^0 \rightarrow 2O_2+OH^0$$

$$O_3+OH^0 \rightarrow O_2+HO_2^0$$

$$HO_2+OH^0 \rightarrow O_2+H_2O$$

Since these reactions proceed through unstable intermediate hydroxyl ions and polyoxides, the reaction with water will continue, and some of the water will be converted to oxygen. In order to suppress the reaction of ozone with any water, the pH of the water may be adjusted to a value lower than about 7, preferably to a range of 2 to 3, by addition of inorganic acid, such as $H_2SO_4$, so for example. This reduces the decomposition of ozone in water.

A small amount of the liquid in the liquid ring is discharged through discharge port 230 with the compressed ozone. It is necessary, therefore, to replenish the lost liquid periodically by metering a quantity of properly chilled and buffered deionized or demineralized water into the liquid supply 115. This process could be applied in a pulp bleaching operation where the slight amount of water will blend in with the liquor of the pulp slurry.

Figure 2:
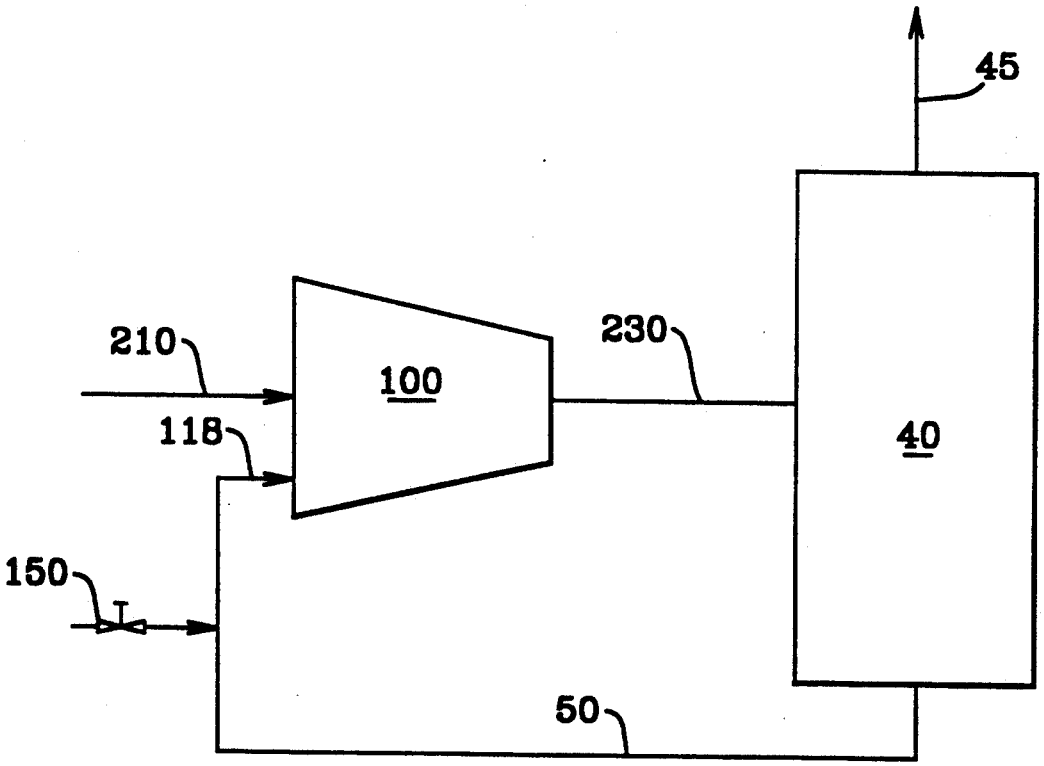
FIG. 2 is a schematic view showing a liquid separator added to the system.

FIG. 2 shows a system for practicing the method of the present invention which includes a liquid separation unit 40. Ozone gas is admitted through inlet port 210 to compressor 100, compressed, and discharged through discharge line 230 to gas separator 40 in which the compressed ozone and entrained water are separated. The compressed ozone is discharged through line 45 to be used in pulp bleaching or other process. Separated liquid is discharged through return line 50 through which it is returned to compressor 100 through liquid supply connection 118. Chilled and/or PH adjusted and/or buffered deionized or demineralized make-up water is added to return line 50 through valve 150, if necessary, to replace water which may be consumed by reactions within the system or lost in saturated vapor discharged from the compressor.

Figure 2A:
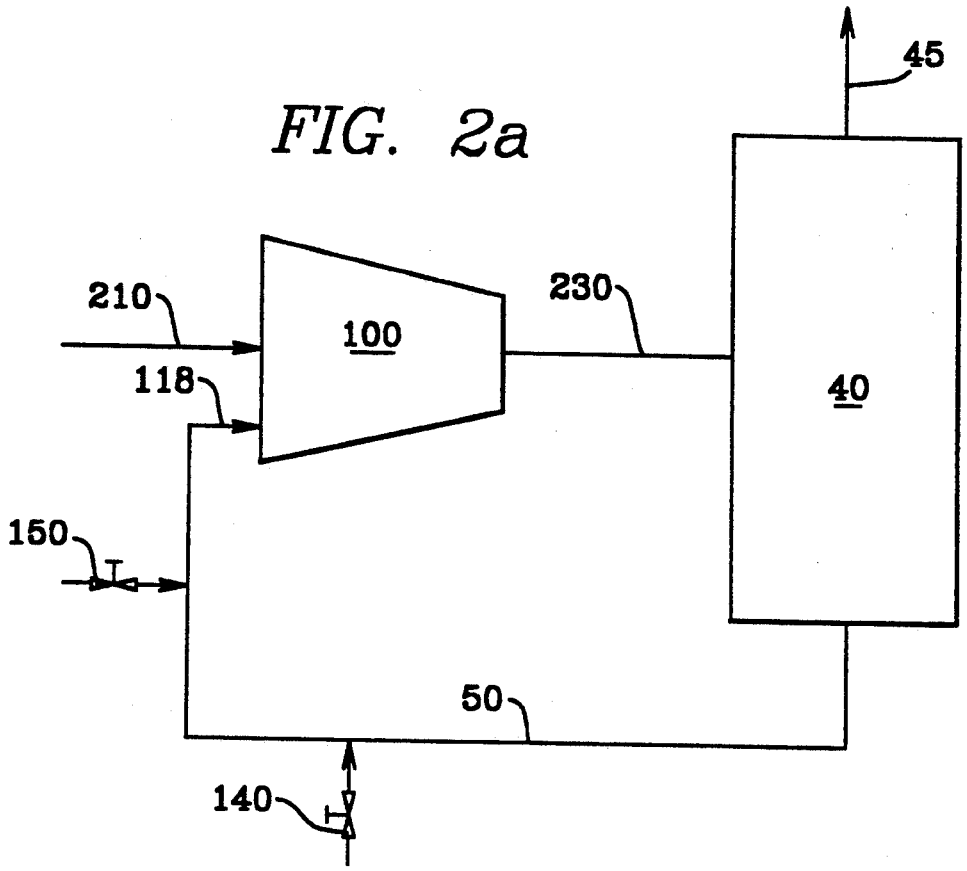
FIG. 2*a* is a view, as in FIG. 2, with addition of an acid supply valve.

FIG. 2*a* shows a system similar to that of FIG. 2, except for the addition of acid supply through valve 140, to control and maintain the pH of the recirculated water loop constant.

Figure 3:
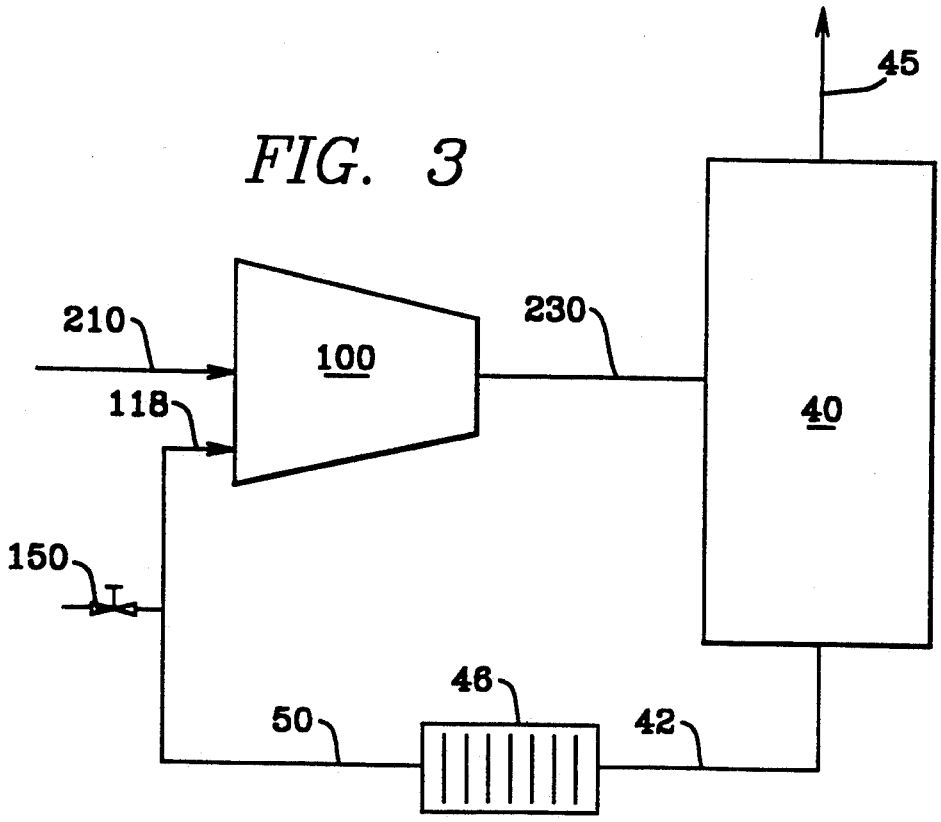
FIG. 3 is a schematic view of the system of FIG. 2 with the addition of a liquid cooling unit.

FIG. 3 shows a system similar to that of FIG. 2, except for the addition of a cooling unit 46 for extracting heat from the water in return line 42 from liquid separator 40. Again, chilled and/or pH adjusted and/or buffered deionized or demineralized make-up water is added to return water in line 50 through valve 150. This closed loop system can also be used for compressing reactive gases which require expensive non-reactive liquid for the liquid compressant or sealant since liquid loss is minimal. Its use for an ozone/water system even improves the economics of this relatively inexpensive process.

Figure 3A:
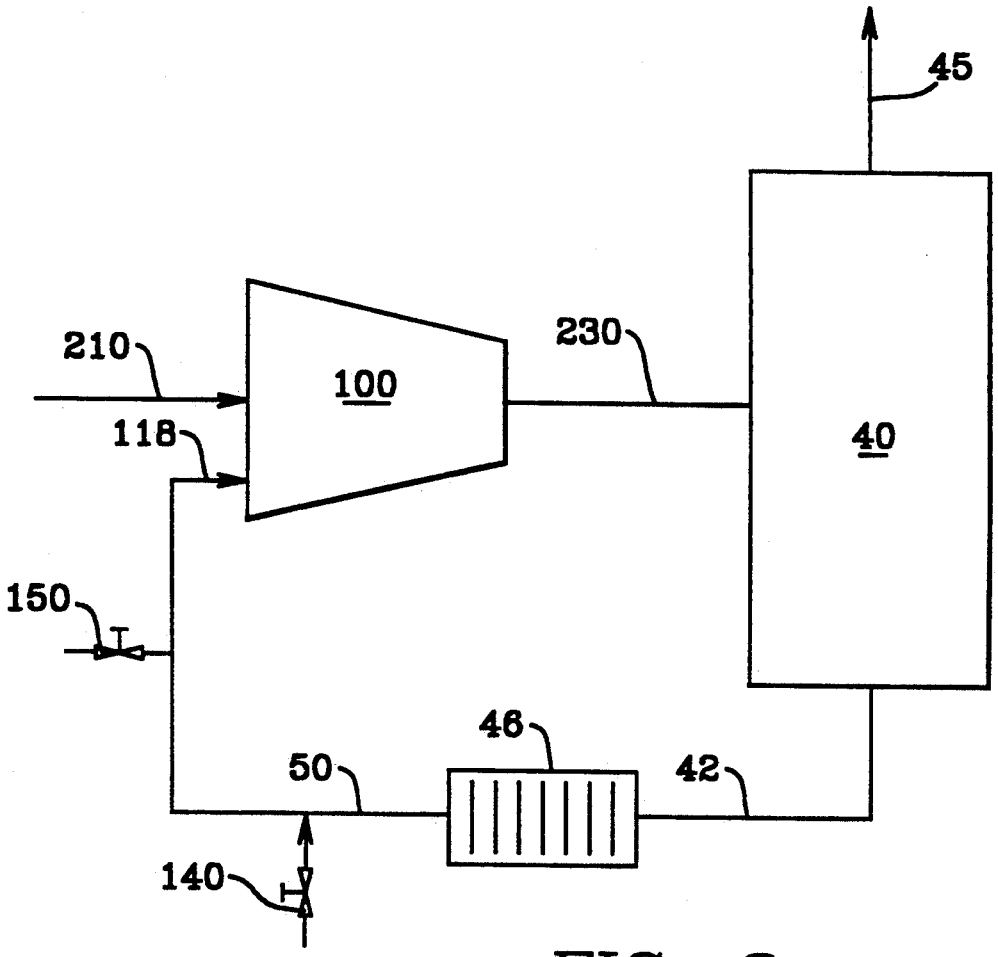
FIG. 3*a* is a view, as in FIG. 3, with addition of an acid supply valve.

FIG. 3*a* shows a system similar to that of FIG. 3, except for the addition of acid supply through valve 140, to control and maintain the pH of the recirculated water loop constant.

Please note that FIGS. 2*a* and 3*a* show systems which will tolerate tap water of reasonable quality; because undesirable reactions are suppressed by lowering the pH by means of the acid supply valve provided.

The embodiments of the process described with reference to the figures represent only four possible embodiments preferred for compressing ozone and other reactive gases. Depending upon the specific application, gas reactivity, gas cost, required gas pressure, and flow rate, the selection of embodiment is quite well defined. The process can significantly reduce loss of gas and improve efficiency of gas compression.

What is claimed is:

1. A method for non-destructively compressing ozone gas, comprising the steps of:

providing a compressor having liquid means for compressing said ozone, and for internally sealing said compressor, said liquid means comprising water in which the pH has been adjusted to a value of less than 7;

feeding said ozone gas to an inlet port of said compressor;

compressing said ozone gas; and extracting compressed ozone gas from a discharge port of said compressor for use in a subsequent process.

2. A method for non-destructively compressing ozone gas, comprising the steps of:

providing a compressor having liquid means for compressing said ozone gas and for internally sealing said compressor, said liquid means comprising deionized water;

feeding said ozone gas to an inlet port of said compressor;

compressing said ozone gas; and extracting compressed ozone gas from a discharge port of said compressor for use in a subsequent process.

3. A method for non-destructively compressing ozone gas, comprising the steps of:

providing a compressor having liquid means for compressing said ozone and for internally sealing said compressor, said liquid means comprising demineralized water;

feeding said ozone gas to an inlet port of said compressor;

compressing said ozone gas; and extracting compressed ozone gas from a discharge port of said compressor for use in a subsequent process.

4. The method of claim 2, wherein the pH of said deionized water is adjusted to a value of less than 7.

5. The method of claim 3, wherein the pH of said demineralized water is adjusted to a value less than 7.

6. The method of claim 1, comprising the further steps of:

employing separation means, connected to said discharge port of the compressor, for separating the compressed ozone gas from any liquid which may be carried out of the compressor with said compressed ozone gas.

7. The method of claim 6, comprising the further steps of:

providing means for cooling the liquid after separation of said compressed ozone gas from said liquid, said liquid being received from said separation means and being processed in a heat exchanger to extract heat of compression which has been absorbed by the liquid from the compressed ozone gas.

8. The method of claim 6, comprising the further step of:

returning liquid from said separation means to said compressor.

9. The method of claim 8, comprising the further step of:

returning cooled liquid from said means for cooling to said compressor.

10. The method of claim 1, comprising the further step of:

providing means for adding make-up liquid to said compressor for replacing liquid which is carried out of the compressor with the compressed ozone gas being discharged from said compressor.

11. The method of claim 8, comprising the further steps of:

adding make-up liquid to said liquid from said separation means to compensate for liquid lost in the process of ozone compression and separation; and adjusting the pH of said liquid from said separation means and said added make-up liquid to a value less than 7.

12. The method of claim 9, comprising the further steps of:

adding make-up liquid to said liquid from said separation means to compensate for liquid lost in the process of ozone compression and separation; and adjusting the pH of said liquid from said separation means and said added make-up liquid to a value less than 7.

* * * * *